US007610000B2

(12) United States Patent
Kim et al.

(10) Patent No.: US 7,610,000 B2
(45) Date of Patent: Oct. 27, 2009

(54) DEVELOPING DEVICE DRIVER AND AN IMAGE FORMING APPARATUS USING THE SAME

(75) Inventors: Sung-dae Kim, Suwon-si (KR); Cheol-young Han, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 542 days.

(21) Appl. No.: 11/481,815

(22) Filed: Jul. 7, 2006

(65) Prior Publication Data

US 2007/0160390 A1 Jul. 12, 2007

(30) Foreign Application Priority Data

Jan. 10, 2006 (KR) ..... 10-2006-0002648

(51) Int. Cl.
*G03G 15/06* (2006.01)

(52) U.S. Cl. ..... 399/222; 399/119; 399/223; 399/279

(58) Field of Classification Search ..... 399/119, 399/222, 223, 279
See application file for complete search history.

(56) References Cited

U.S. PATENT DOCUMENTS 5,585,898 A * 12/1996 Fujii ..... 399/228
6,609,707 B1 * 8/2003 Yano ..... 271/10.05
6,868,245 B2 * 3/2005 Kinouchi ..... 399/227
2005/0041996 A1 * 2/2005 Kishigami ..... 399/227
2005/0180779 A1 * 8/2005 Okamoto ..... 399/222

FOREIGN PATENT DOCUMENTS

| | | |
|---|---|---|
| JP | 2002-099129 | 4/2002 |
| JP | 2003-215880 | 7/2003 |
| JP | 2003-263004 | 9/2003 |
| JP | 2003-329090 | 11/2003 |
| KR | 1020040000746 | 1/2004 |

OTHER PUBLICATIONS

Chinese Office Action Dated Mar. 31, 2009.

* cited by examiner

*Primary Examiner*—David M Gray
*Assistant Examiner*—Ryan D Walsh
(74) *Attorney, Agent, or Firm*—Roylance, Abrams, Berdo & Goodman, L.L.P.

(57) ABSTRACT

A developing device driver according to the present invention includes a developing roller gear connected to each developing roller to develop an electrostatic latent image formed on a photoconductive medium with developer having predetermined color, a driving source for generating power for rotating the developing roller gear, a driving gear driven by the power transmitted from the driving source, and a power switching gear provided with power from the driving gear and rotated along a circumference of the driving gear, and a rotation unit. The rotation unit rotates the power switching gear to place the power switching gear into contact with and separate the gear from the developing roller gears to selectively drive one developing roller.

18 Claims, 7 Drawing Sheets

DEVELOPING DEVICE DRIVER AND AN IMAGE FORMING APPARATUS USING THE SAME

CROSS-REFERENCE TO RELATED APPLICATIONS

This application claims the benefit under 35 U.S.C. § 119 (a) of Korean Patent Application No. 2006-2648, filed Jan. 10, 2006, the entire contents of which are hereby incorporated by reference.

BACKGROUND OF THE INVENTION

1. Field of the Invention

The present invention relates to a developing device driver for a color image forming apparatus, and a color image forming apparatus using the same. More particularly, the present invention relates to a developing device driver for a color image forming apparatus that sequentially drives a plurality of developing devices arranged at a predetermined interval from a photoconductive medium, and an image forming apparatus using the same.

2. Description of the Related Art

Typical image forming apparatuses such as a laser beam printer operate as follows. A light is projected on a photoconductive medium electrified to a certain potential to form an electrostatic latent image on the photoconductive medium. The electrostatic latent image is developed by developers having predetermined colors using a developing device, transferred onto a recording medium through a transfer medium such as a transfer belt, fixed onto the recording medium by a fixing device, and then discharged from the main body of the apparatus.

Color images are typically formed by using either a single-path or a multi-path method. A single-path method uses four laser scanning units (LSUs) and photoconductive mediums, and a multi-path method uses a single LSU and photoconductive medium.

FIG. 1 shows part of the structure of a conventional color image forming apparatus to explain the developing operation of the multi-path method.

Referring to FIG. 1, developing devices 5Y, 5M, 5C and 5K for four colors comprise developing rollers 6Y, 6M, 6C and 6K, respectively. In order to develop an electrostatic latent image, for example, a yellow image formed on a photoconductive drum 3 for the first time, a predetermined bias voltage is applied to the yellow developing roller 6Y, and the yellow developing roller 6Y is rotated by a developing unit driving motor (not shown). As a result, developer adhered to a surface of the yellow developing roller 6Y is transferred to the electrostatic latent image on the photoconductive drum 3. Then, the developed yellow image is transferred onto a transfer belt 7.

Next, another electrostatic latent image, for example, a magenta image is formed and developed. A predetermined developing bias voltage is applied to the magenta developing roller 6M, and the magenta developing roller 6M is driven to develop the electrostatic latent image on the photoconductive drum 3. The developed magenta image is transferred so that it overlaps the yellow image on the transfer belt 7. Cyan and black images are developed and transferred through the same processes, thereby producing a final color image on the transfer belt 7. The final color image formed on the transfer belt 7 is transferred to a recording medium P1 supplied between the transfer belt 7 and a transfer roller 9.

In FIG. 1, developing roller gears 8Y, 8M, 8C and 8K drive the developing rollers 6Y, 6M, 6C and 6K.

FIG. 2 is a perspective view showing a structure of a driver for the developing unit of FIG. 1.

Referring to FIG. 2, the developing roller gears 8Y, 8M, 8C and 8K are connected by intermediate gears 11Y, 11M, 11C and 11K, and the intermediate gears 11Y, 11M, 11C and 11K are supplied and cut off with power transmitted from a driving source (not shown) by electric clutches 13Y, 13M, 13C and 13K.

More specifically, when developing the yellow image, the yellow electric clutch 13Y is turned on, and the power of the motor is transmitted to drive the yellow intermediate gear 11Y. The power is transmitted to the yellow developing roller gear 8Y and accordingly, the yellow developing roller 6Y is driven. At this time, the developing bias voltage is applied to the yellow developing roller 6Y so that the developer attached to the surface of the yellow developing roller 6Y develops the electrostatic latent image formed on the photoconductive drum 3.

When driving the magenta developing roller 6M, the developing bias voltage applied to the yellow developing roller 6Y and the yellow electric clutch 13Y are turned off, and the developing bias voltage for the magenta image and the magenta electric clutch 13M are turned on. Therefore, the power of the driving source is transmitted to the magenta developing roller gear 8M to drive the magenta developing roller 6M.

The same processes are applied to develop the cyan and the black images.

The use of a plurality of electric clutches increase material cost and increase the overall size of the apparatus. Additionally, the electric clutch may slip, which produces a delay in the operational time. Therefore, the electric clutch may generate timing errors. Moreover, the electric clutch generates noise during the operation.

Accordingly, there is a need for a developing device driver for a color image forming apparatus which has a reduced number of parts, improved timing accuracy, and reduced noise.

SUMMARY OF THE INVENTION

An aspect of the present invention is to address at least the above problems and/or disadvantages and to provide at least the advantages described below. Accordingly, an aspect of the present invention is to provide a developing device driver for a color image forming apparatus which has a reduced number of parts.

Another aspect of the present invention is to provide a developing device driver for a color image forming apparatus which is capable of improving operational reliability.

Yet another aspect of the present invention is to provide a developing device driver for a color image forming apparatus which reduces the amount of noise generated during the operation of the developing device.

Still another aspect of the present invention is to provide a color image forming apparatus using the above described developing device driver.

In accordance with an aspect of the present invention, a developing device driver comprises a developing roller gear connected to each developing roller. Each developing roller develops an electrostatic latent image formed on a photoconductive medium with a developer having a predetermined color. A driving source generates power for rotating the developing roller gear, and a driving gear is driven by the power transmitted from the driving source. A power switching gear engages the driving gear and is rotated by along a circumference of the driving gear. A rotation unit rotates the power switching gear to place the power switching gear into contact with and separate the power switching gear from a developing roller gear so that power is selectively transmitted to the selected developing roller gear.

The rotation unit may comprise a rotary lever having a first end and a second end. The first end is rotatably supported, and the second end is connected to the power switching gear. A rotation control unit is connected to the first end of the rotary lever to control the rotational position of the rotary lever.

The axis of the rotary lever may correspond to the axis of the driving gear.

The rotation control unit may comprise a stepping motor or a spring clutch.

The rotation control unit may be capable of rotating clockwise and counterclockwise.

In accordance with another aspect of the present invention, a color image forming apparatus comprises at least one photoconductive medium on which an electrostatic latent image is formed, at least two developing devices comprising a developing roller for forming a developer image by developing the electrostatic latent image formed on the photoconductive medium with color developer, a transfer belt onto which the developer images are transferred to form a color image, a transfer roller for transferring the color image formed on the transfer belt onto a recording medium, and a developing device driver for selectively driving the developing rollers. The developing device driver may comprise a driving source, a driving gear connected to the driving source, a power switching gear engaged with the driving gear and rotated along a circumference of the driving gear, a rotation unit for rotating the power switching gear, and developing roller gears connected with and separated from the power switching gear and provided to the respective developing rollers.

The rotation unit may comprise a rotary lever having a first end and a second end. The first end is rotatably supported, and the second end is connected to the power switching gear. The rotation control unit is connected to the first end of the rotary lever to control the rotational position of the rotary lever.

The axis of the rotary lever may correspond to the axis of the driving gear.

The rotation control unit may comprise a stepping motor or a spring clutch.

The rotation control unit may be capable of rotating clockwise and counterclockwise.

In accordance with another aspect of the present invention, a color image forming apparatus comprises a photoconductive medium for forming electrostatic latent images, a plurality of developing rollers for developing electrostatic latent images formed on the photoconductive medium, each developing roller having a developing roller gear for driving the developing roller, and means for selectively driving the developing rollers.

The means for selectively driving the developing rollers may comprise a driving source, a driving gear connected to the driving source, a power switching gear engaged with the driving gear and rotated along a circumference of the driving gear, and a rotation unit for rotating the power switching gear so that the power switching gear is placed into contact with one of the developing roller gears of the plurality of developing rollers to transmit power from the driving gear to the selected developing roller gear.

The rotation unit may comprise a rotary lever having a first end and a second end. The first end is rotatably supported, and the second end is connected to the power switching gear. The rotation control unit is connected to the first end of the rotary lever to control the rotational position of the rotary lever.

The axis of the rotary lever may correspond to the axis of the driving gear.

The rotation control unit may comprise a stepping motor or a spring clutch.

The rotation control unit may be capable of rotating clockwise and counterclockwise.

BRIEF DESCRIPTION OF THE DRAWING FIGURES

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
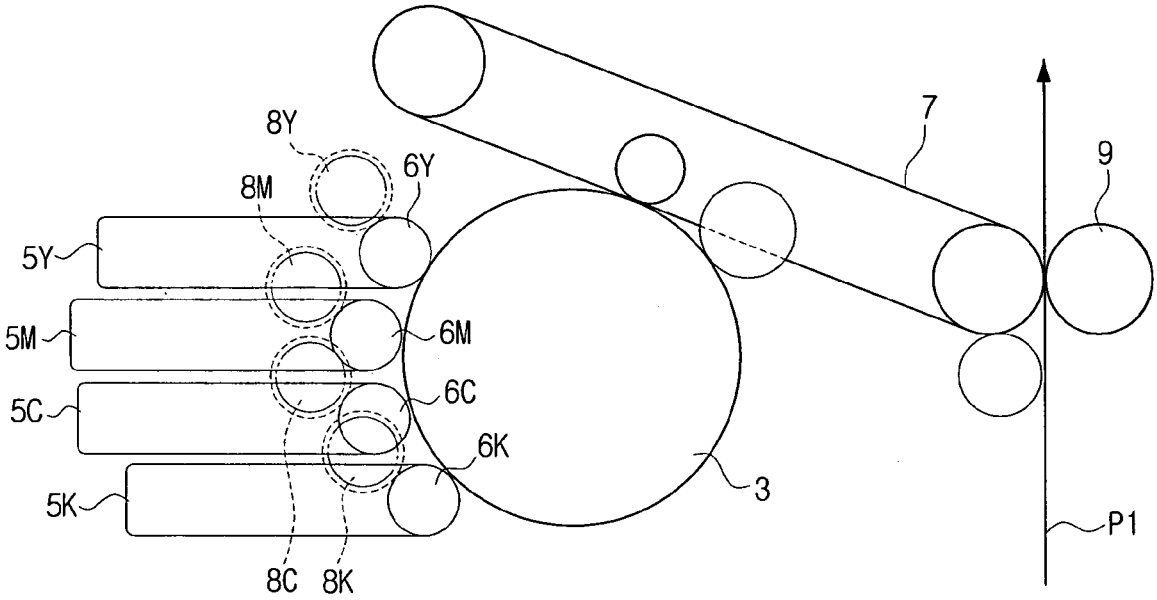
FIG. 1 (PRIOR ART)
FIG. 1 is a side view of a portion of a conventional color image forming apparatus.
Figure 2:
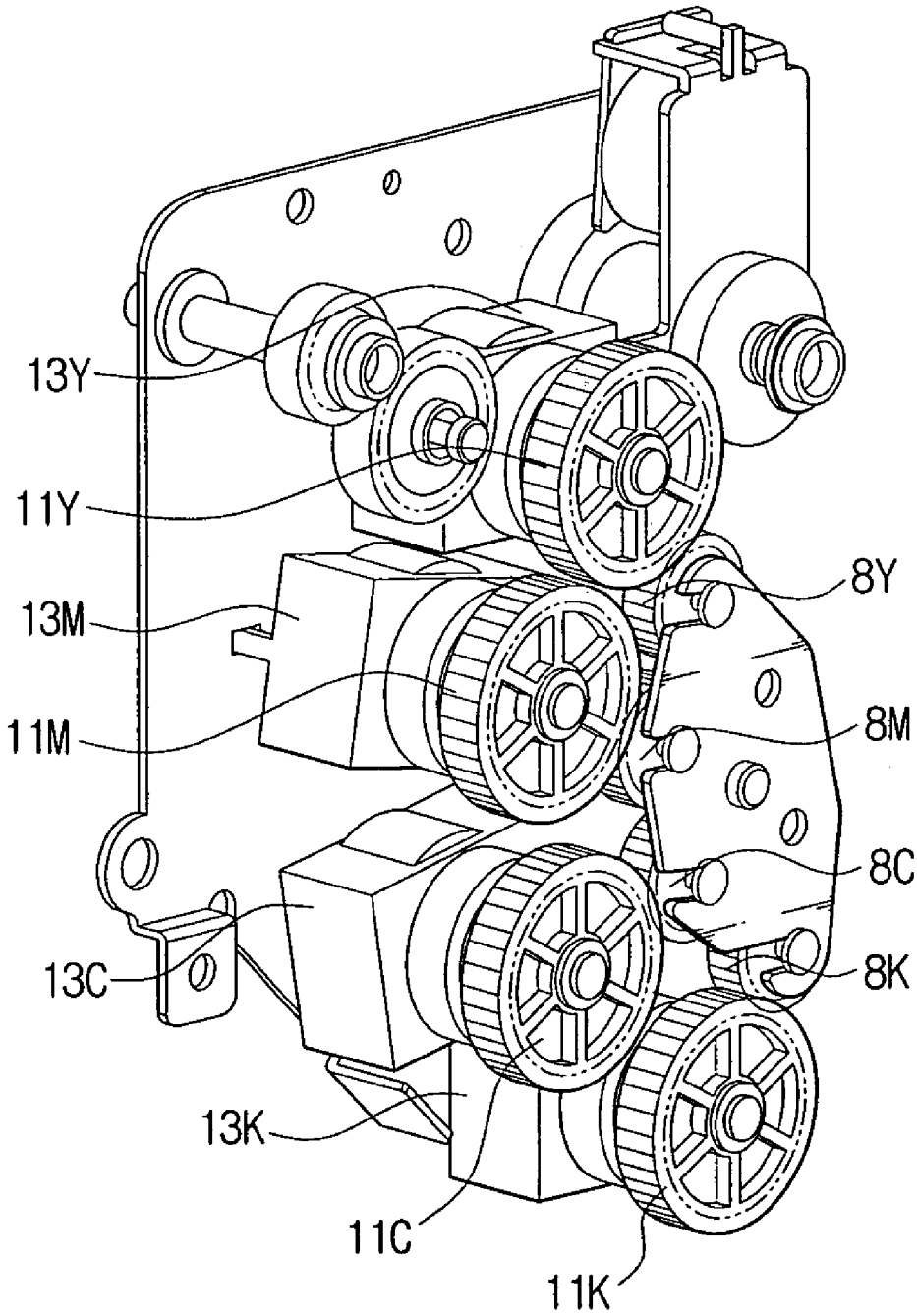
FIG. 2 (PRIOR ART)
FIG. 2 is a perspective view of the structure of the developing device of FIG. 1.
Figure 3:
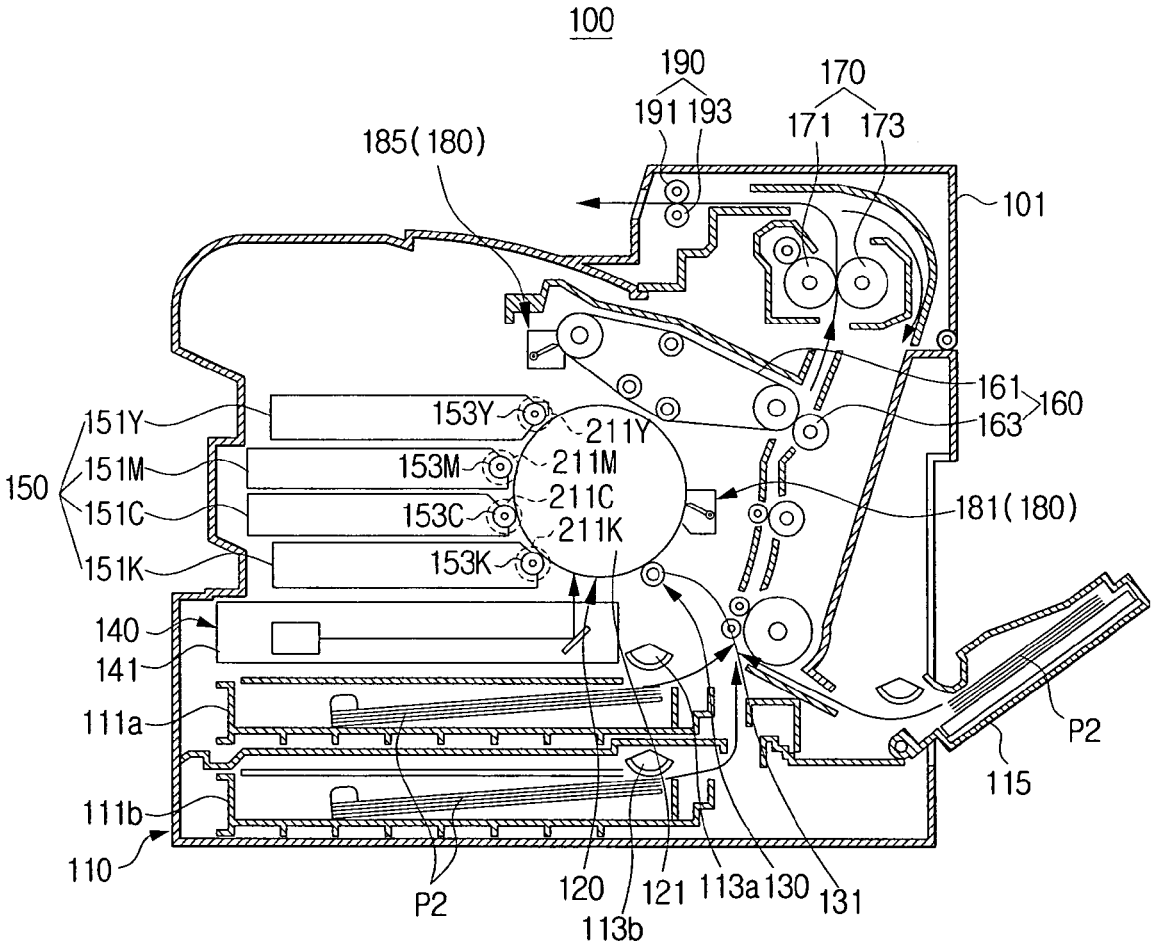
FIG. 3 is a schematic view of the structure of a color image forming apparatus according to an exemplary embodiment of the present invention.

FIG. 3 is a schematic view of the structure of a color image forming apparatus that employs a developing device driver according to an exemplary embodiment of the present invention.

Referring to FIG. 3, the color image forming apparatus 100 comprises a main body 101, a recording medium feeding unit 110, a photoconductive unit 120, a charging unit 130, a light exposure unit 140, a developing unit 150, a transfer unit 160, a fixing unit 170, a cleaning unit 180, and a paper-discharge unit 190.

The recording medium feeding unit 110 comprises recording medium cassettes 111*a* and 111*b* for stacking therein plural sheets of recording medium P2, and pickup rollers 113*a* and 113*b* for picking up the recording medium P2 stacked in the recording medium cassettes 111*a* and 111*b*. A multi-purpose feeder (MPF) 115 may be additionally provided.

An electrostatic latent image may be formed on the surface of the photoconductive unit 120. For this, the photoconductive unit 120 may comprise a photoconductive drum 121 with a photoconductive layer on a circumference of a cylindrical metal drum.

The charging unit 130 evenly electrifies the photoconductive drum 121 to have a certain potential. To this end, the charging unit 130 may comprise a charging roller 131 for supplying an electric charge as it rotates to the circumference of the photoconductive drum 121. The charging roller 131 may be placed into contact with the photoconductive drum 121, or may be spaced away from the photoconductive drum 121.

The light exposure unit 140 scans the photoconductive drum 121 charged to an even potential by the charging roller 131, with light corresponding to a desired image to be formed, thereby forming the electrostatic latent image. Generally, the light exposure unit 140 is a laser scanning unit (LSU) 141.

The developing unit 150 comprises four developing devices 151Y, 151M, 151C and 151K which store developers of four respective colors, such as yellow, magenta, cyan and black. The developing unit 150 also comprises developing rollers 153Y, 153M, 153C and 153K for supplying the developers to the electrostatic latent image formed on the photoconductive drum 121 to develop the electrostatic latent image to a developer image.

The transfer unit 160 comprises a transfer belt 161 and a transfer roller 163. Yellow, magenta, cyan and black developer images formed on the photoconductive drum 121 are sequentially transferred and overlapped on the transfer belt 121, thereby forming a full color image. The transfer roller 163 transfers the full color image formed on the transfer belt 161 onto the recording medium P2. More specifically, the transfer roller 163 is disposed apart from the transfer belt 161 while the color image is being transferred to the transfer belt 161, and brought into contact with the transfer belt 161 with a predetermined pressure for transferring the color image to the recording medium P2 after the color image is completely transferred on the transfer belt 161.

The fixing unit 170 heats up and presses the color image transferred on the recording medium P2 through the transfer unit 160, and comprises a heating roller 171 and a pressing roller 173.

The cleaning unit 180 comprises a first cleaning unit 181 that removes residual developer remaining on the photoconductive drum 121 after transfer of the developer image onto the transfer belt 161, and a second cleaning unit 185 that removes residual developer remaining on the transfer belt 161 after transfer of the color image onto the recording medium P2.

The paper-discharge unit 190 comprises a discharge roller 191 and a discharge idle roller 193 to discharge the recording medium P2 on which the color image is fixed through the fixing unit 170 to the outside of the main body 101.

Developing roller gears 211Y, 211M, 211C and 211K rotate the developing rollers 153Y, 153M, 153C and 153K.

The process of forming an image with the above described structure will now be described.

The surface of the photoconductive drum 121 is evenly charged with electric potential by the charging roller 131. When an optical signal corresponding to the yellow image is projected to the photoconductive drum 121 by the light exposure unit 140, an electrostatic latent image is formed on the surface of the photoconductive drum 121.

As the photoconductive drum 121 is rotated, the electrostatic latent image approaches the yellow developing device 151Y. Accordingly, the yellow developing roller 153Y of the yellow developing device 121 is rotated, thereby developing the electrostatic latent image formed on the surface of the photoconductive drum 121 with the yellow developer.

Then, the yellow developer image developed on the surface of the photoconductive drum 121 is transferred onto the transfer belt 161 running along a loop in contact with the surface of the photoconductive drum 121.

After the yellow developer image is completely transferred to the transfer belt 161, the magenta, cyan and black developer images are developed and transferred to the transfer belt 161 through the same processes, so that they overlap one another to form a color image.

Up until this point, the transfer roller 163 is spaced away from the transfer belt 161. After the color image is formed by transferring and overlapping all the four developer images to the transfer belt 161, the transfer roller 163 is brought into contact with the transfer belt 163 to transfer the color image to the recording medium P2.

Next, the recording medium P2 bearing the transferred color image thereon is passed through the fixing unit 170. The color image transferred to the recording medium P2 is fixed by the heat and pressure of the fixing unit 170. The recording medium P2 on which the color image is fixed is discharged to the outside of the main body 101 by the paper-discharge unit 190.

The first and the second cleaning units 181 and 185 clean the residual developer remaining on the photoconductive drum 121 and the transfer belt 161 for the next use.

Figure 4:
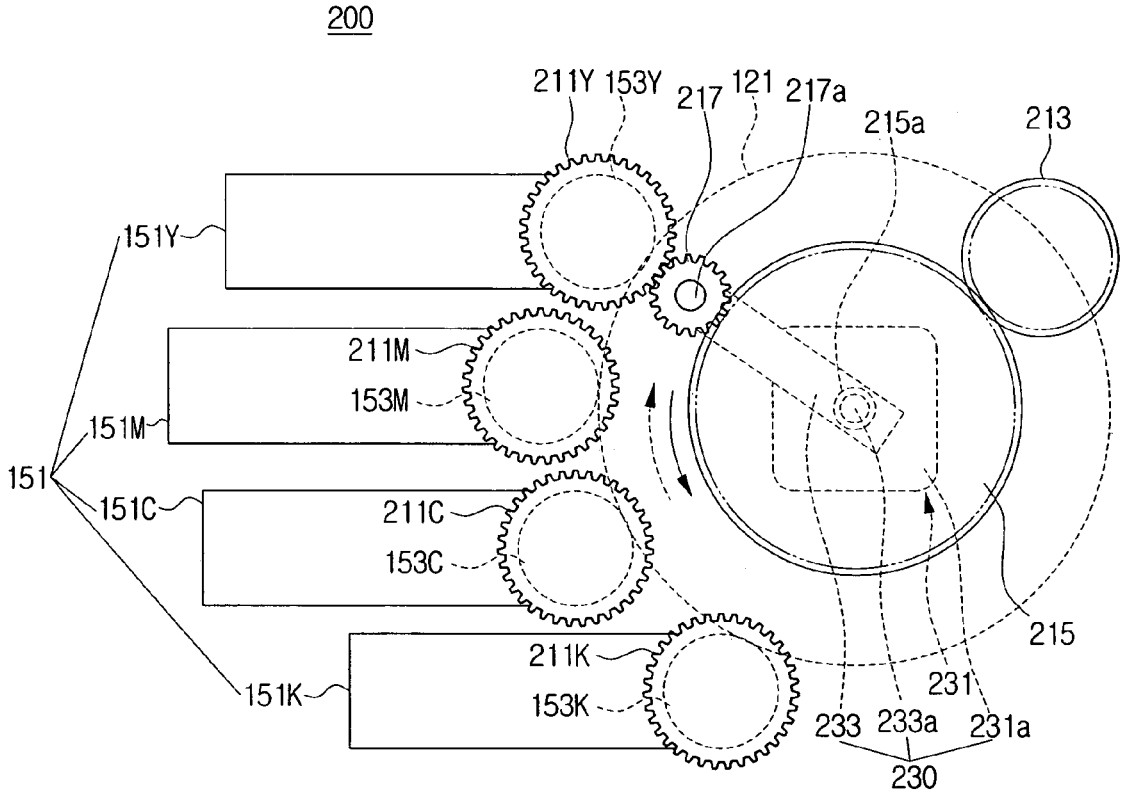
FIG. 4 is a plan view of the structure of a developing device driver for a color image forming apparatus according to an exemplary embodiment of the present invention.
Figure 5:
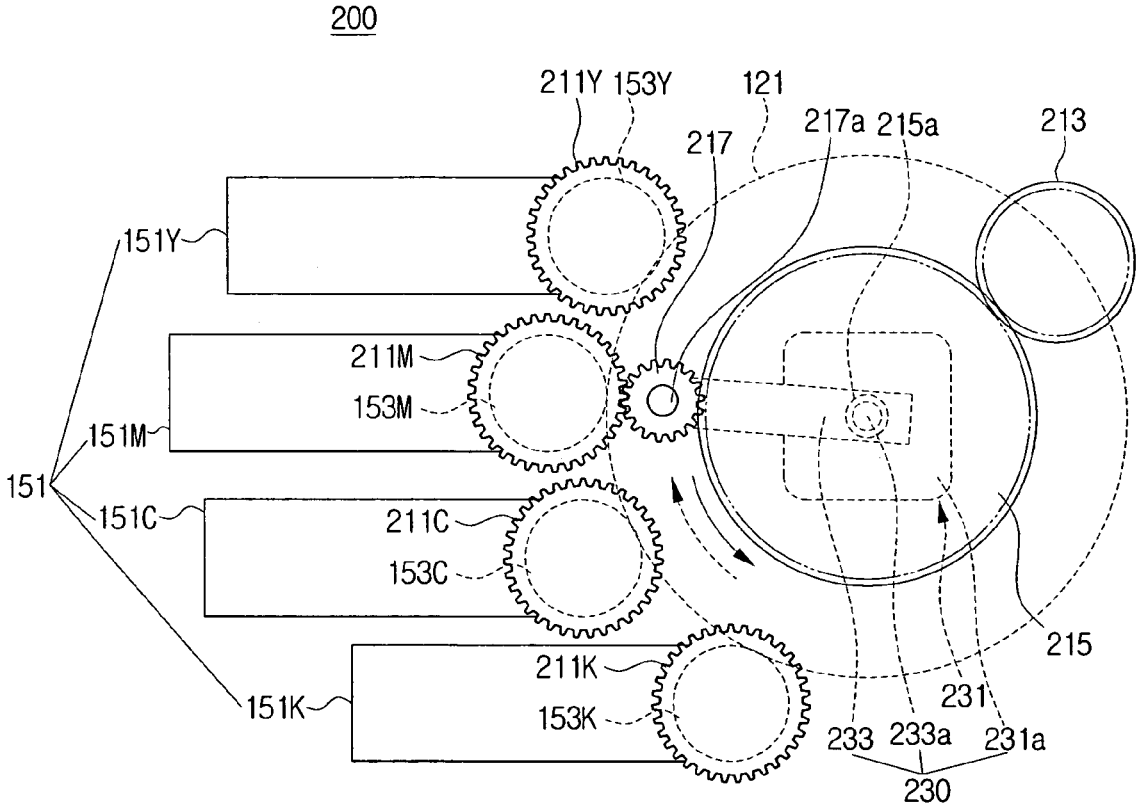
FIG. 5 is a plan view of the structure of the developing device driver of FIG. 4, where a magenta developing device is driven as a rotary lever of the developing device driver is rotated.

FIG. 4 is a plan view of the structure of the developing device driver for a color image forming apparatus according to an exemplary embodiment of the present invention. FIG. 5 is a plan view of the developing device driver of FIG. 4, with the rotary lever rotated so that it drives the magenta developing device 151M.

Referring to FIGS. 4 and 5, a developing device driving unit 200 comprises developing roller gears 211Y, 211M, 211C and 211K connected with the developing rollers 153Y, 153M, 153C and 153K, a driving source 213 generating power for rotating the developing roller gears 211Y, 211M, 211C and 211K, a driving gear 215 driven by the power transmitted from the driving source 213, a power switching gear 217 connected with the driving gear 215 which may be placed into contacted with and separated from the developing roller gears 211Y, 211M, 211C and 211K, and a rotation unit 230 for swinging the power switching gear 217.

The rotation unit 230 comprises a rotation control unit 231 for supplying power for rotating the power switching gear 217, and a rotation lever 233. The first end of the rotation lever 233 is rotatably supported by the rotation control unit 231 and the second end of the rotation lever 233 rotatably mounts the power switching gear 217.

The power switching gear 217 receives power from the driving gear 215 and is rotated about a gear axis 217*a*. Also, the power switching gear 217 rotates along an outer circumference of the driving gear 215 according to the pivoting of the rotary lever 233. During this operation, the distance between the axis of the power switching gear 217 and the axis of the driving gear 215 should be constant. For this, the driving gear axis 215*a* is coaxial with the lever axis 233*a* of the rotary lever 233, and the power switching gear 217 is mounted to the second end of the rotary lever 233 through the gear axis 217*a*.

The rotation control unit 231 may comprise a stepping motor 231*a* to control the rotational position of the rotary lever 233. Therefore, the rotation control unit 231 pivots and stops the rotary lever 233 at positions corresponding to the respective developing devices 151Y, 151M, 151C and 151K. The rotation control unit 231 may be driven clockwise and counterclockwise to restore the rotary lever 233 to its initial position.

Alternatively, the rotation control unit 231 may comprise a spring clutch. This structure will be described in greater detail with reference to FIGS. 6 and 7 later.

Referring to FIG. 4, to develop a yellow image, a predetermined pulse is applied to the stepping motor 231*a*, that is, the rotation control unit 231. The rotary lever 233 is pivoted by a predetermined angle on the lever axis 233*a* and the power switching gear 217 is placed into contact with the yellow developing gear 211Y.

As a result, the power of the driving gear 215 is transmitted to the yellow developing gear 211Y through the power switching gear 217, thereby rotating the yellow developing roller 153Y. At this time, developing bias voltage is applied to the yellow developing roller 153Y and therefore, the developer attached to the surface of the yellow developing roller 153Y develops the electrostatic latent image on the photoconductive drum 121.

Referring to FIG. 5, to drive the magenta developing roller 153M, a pulse for pivoting the rotary lever 233 by a greater angle than before is applied to the stepping motor 231*a*. At this time, the developing bias voltage applied to the yellow developing roller 153Y is cut off, and a developing bias voltage is applied to the magenta developing roller 153M The same processes are repeated to develop cyan and black images in sequence.

When the rotary lever 233 is restored to its initial position to drive the yellow developing roller 153Y again after sequentially driving the developing rollers 153Y, 153C, 153M and 153K, the rotary lever 233 may be pivoted in the direction shown by the solid arrow, that is, counterclockwise, or may be pivoted in the direction shown by the dashed arrow, that is, clockwise. If the rotary lever 233 is pivoted counterclockwise, the power switching gear 217 may be restored to its initial position without contacting the cyan and the magenta developing roller gears 211C and 211M. To do so, however, the power switching gear must be capable of pivoting 360°. On the other hand, if the power switching gear 217 is pivoted in the opposite direction, that is, clockwise, the required pivoting range of the power switching gear is less than 360°, and the operating time may be reduced. However, the power switching gear 217 may rotate the cyan and the magenta developing roller gears 211C and 211M as it is restored to its initial position. Any such rotation of the cyan and the magenta developing roller gears 211C and 211M is too insignificant to affect the image formation processes or the lifespan of the apparatus.

Figure 6:
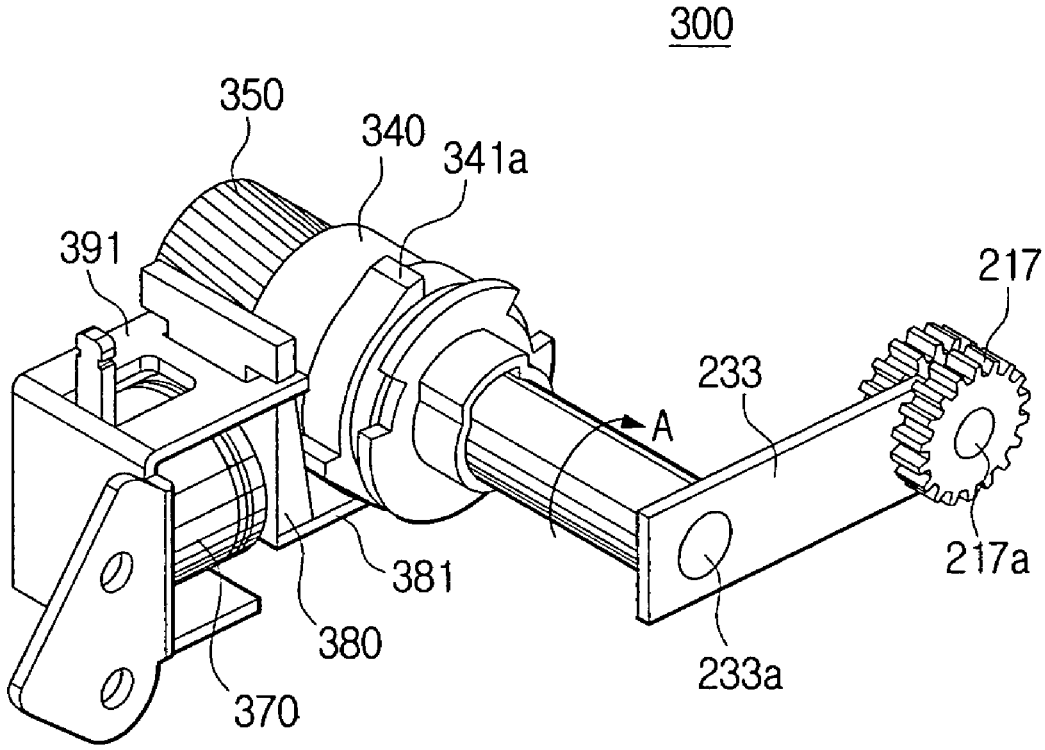
FIG. 6 is a perspective view of the structure of a rotation unit according to another exemplary embodiment of the present invention.
Figure 7:
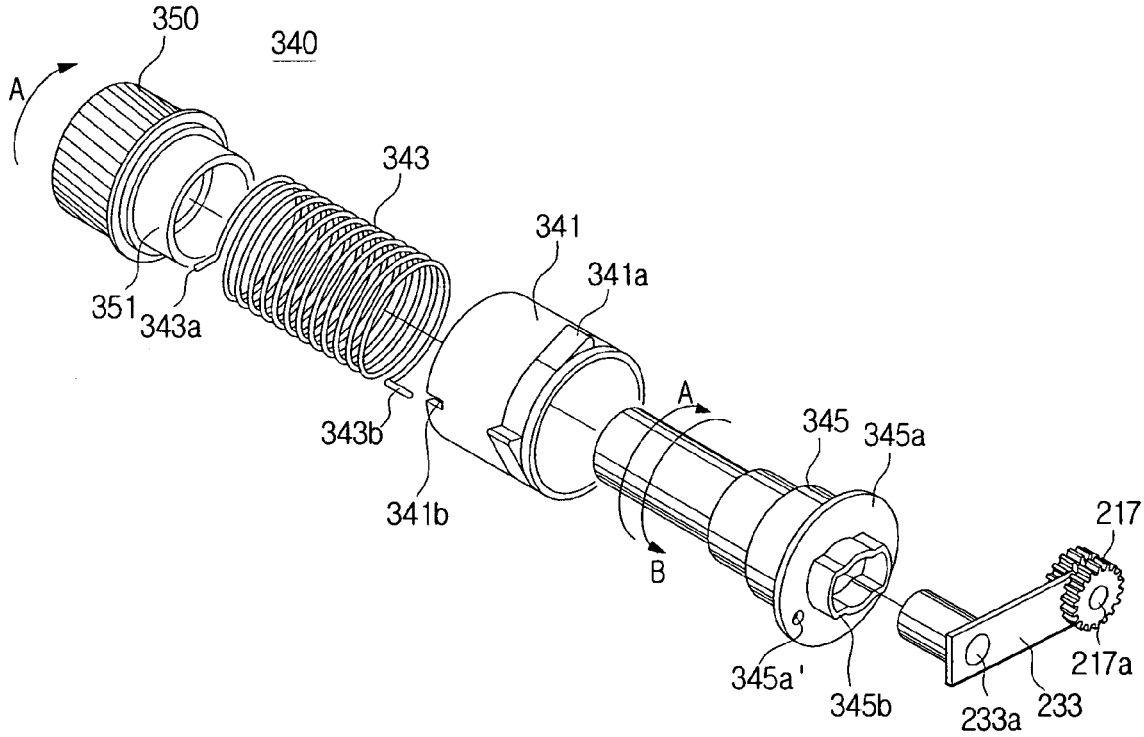
FIG. 7 is an exploded perspective view of the structure of FIG. 6.

FIG. 6 is a perspective view of a rotation unit according to another exemplary embodiment of the present invention. FIG. 7 is an exploded perspective view of the rotation unit of FIG. 6.

In FIG. 6, a spring clutch 300 is employed instead of the stepping motor 231*a* of FIG. 4. The spring clutch 300 comprises a clutch driving gear 350, and a spring clutch assembly 340 connecting the lever axis 233*a*, one end of which is connected to the rotary lever 233, to the clutch driving gear 350. The clutch driving gear 350 is connected to a motor (not shown) through a gear train (not shown). Further, a solenoid 370 is provided to control the rotational position of the rotary lever 233 by selectively supplying a load to the spring clutch assembly 340.

A plurality of slant projections 341*a* are arranged at predetermined intervals on a surface of a cylindrical body 341 which constitutes the spring clutch assembly 340. Here, five slant projections 341*a* may be provided to control the positions where the power switching gear 217 corresponds to the four developing roller gears 211Y, 211M, 211C and 211K and a position where the power switching gear 217 is associated with none of the developing roller gears 211Y, 211M, 211C and 211K.

A locking member 380 has a hook 381 for engagement with the slant projections 341*a*, and hinged to a solenoid bracket 391.

The solenoid 370 is fixed to the solenoid bracket 391, and comprises a plunger (not shown) made of metal or a magnetic material and pivotably connected to the locking member 380 to move the locking member 380 between locking and releasing positions. The plunger is pressed by a compressing spring (not shown) to bias the locking member 380 to the locking position.

Referring to FIG. 7, the spring clutch assembly 340 comprises a first hub 351 formed at one side of the clutch driving gear 350.

The cylindrical body 341 is rotatably fit around a circumferential surface of the first hub 351. A spring 343 is interposed between the first hub 351 and the cylindrical body 341, in sliding contact with the first hub 351.

A first end 343*a* of the spring 343 is fixed to a spring fixing cut 341*b* of the cylindrical body 341. The other end 343*b* of the spring 343 is fixed to a spring fixing hole 345*a*' formed on a flange 345*a* of a second hub 345.

The second hub 345 is connected to the lever axis 233*a* through a fixing member 345*b* of the flange 345*a*. The spring 343 is fit around the circumferential surface of the second hub 345.

The operation of the developing device with the spring clutch 300 will now be described in detail. In the following description, only the pivoting operation of the rotary lever 233, which is different from the operation of the developing device described above with respect to FIGS. 4 and 5, will be described in detail. The other operations are same as previously described and therefore a detailed description will not be repeated.

Referring to FIGS. 6 and 7, when the solenoid 370 is switched on, the plunger is pulled by magnetism generated from an inner coil of the solenoid 370, thereby moving the locking member 380 to the releasing position where the hook 381 is released from the slant projection 341*a*.

When the locking member 380 is moved to the releasing position, the cylindrical body 341 of the spring 343 is rotated by the sliding contact between the first hub 351 and the spring clutch assembly 340 in the direction of the arrow A, that is, a rotational direction of a clutch driving gear 350. According to the rotation of the cylindrical body 341, the spring 343 fixed in the spring fixing hole 345*a*' of the flange 345*a* tightly encloses the circumferential surfaces of the first and the second hubs 351 and 345. As a consequence, the rotational force of the clutch driving gear 350 is transmitted to the lever axis 233*a* through the first and the second hubs 351 and 345 and the spring 343. Therefore, the lever axis 233*a* is rotated in the direction A.

At this time, the rotary lever 233 in connection with the lever axis 233*a* is rotated together so that the power switching gear 217 is connected to the yellow developing roller gear 211Y.

Next, as described above, rotary lever 233 is rotated to operate the magenta, the cyan and the black developing devices 151M, 151C and 151K by compressing and releasing the spring 343 according to the on and off states of the solenoid 370.

The spring clutch assembly 340 is locked so that the cylindrical body 341 that fixes the first end 343*a* of the spring 343 is not rotated by the locking member 380 when the solenoid 370 is turned off. Therefore, although the clutch driving gear 350 rotates, the first hub 351 idly rotates and slides by the spring 343. As a result, the rotational force of the clutch driving gear 350 is not transmitted to the second hub 345.

Although the four developing devices are driven in sequence with respect to one photoconductive medium in the above description, the present invention is not limited to this structure. For example, two photoconductive mediums may be provided to control the power supply in a sub-group form in a manner that each of the photoconductive mediums selectively drives two developing devices, respectively.

With the above-described developing device driver of the present invention, the structure of the developing device driver is simplified and the number of parts is reduced. As a result, material costs and product size can be reduced. In addition, timing errors which are generated in conventional products by slip of the electric clutch are basically eliminated, thereby improving operational reliability. Furthermore, noise generated from the conventional electric clutch can be attenuated.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developing device driver comprising:

a plurality of developing roller gears connected to a respective developing roller, the developing roller developing an electrostatic latent image formed on a photoconductive medium with developer;

a driving source to rotate the developing roller gear;

a driving gear driven by power transmitted from the driving source;

a single power switching gear engaged with the driving gear and rotated along a circumference of the driving gear, wherein said single power switching gear is sequentially placed into contact with and separated from each of the plurality of the developing roller gears; and a rotation unit to rotate the power switching gear.

2. The developing device driver of claim 1, wherein the rotation unit comprises:

a rotary lever having a first and a second end, the first end being rotatably supported, and the second end being connected to the power switching gear; and a rotation control unit connected to the first end of the rotary lever to control the rotational position of the rotary lever.

3. The developing device driver of claim 2, wherein the axis of the rotary lever corresponds to the axis of the driving gear.

4. The developing device driver of claim 2, wherein the rotation control unit comprises a stepping motor.

5. The developing device driver of claim 2, wherein the rotation control unit comprises a spring clutch.

6. The developing device driver of claim 2, wherein the rotation control unit is capable of rotating clockwise and counterclockwise.

7. A color image forming apparatus comprising:

at least one photoconductive medium on which an electrostatic latent image is formed;

at least two developing devices, each developing device comprising a developing roller to form a developer image by developing the electrostatic latent image formed on the photoconductive medium with developer;

a transfer belt onto which the developer images are transferred, thereby forming a color image;

a transfer roller to transfer the color image formed on the transfer belt onto a recording medium; and a developing device driver to drive the developing rollers, the developing device driver comprising a driving source, a driving gear connected to the driving source, a single power switching gear engaged with the driving gear and rotated along a circumference of the driving gear, a rotation unit to rotate the power switching gear, and developing roller gears which are adapted to be connected with and separated from the power switching gear, the developing roller gears being provided to the developing rollers, wherein said single power switching gear is adapted to be sequentially connected with and separated from each of the developing roller gears.

8. The color image forming apparatus of claim 7, wherein the rotation unit comprises:

a rotary lever having a first and a second end, the first end being rotatably supported, and the second end being connected to the power switching gear; and a rotation control unit connected to the first end of the rotary lever to control the rotational position of the rotary lever.

9. The color image forming apparatus of claim 7, wherein the axis of the rotary lever corresponds to the axis of the driving gear.

10. The color image forming apparatus of claim 7, wherein the rotation control unit comprises a stepping motor.

11. The color image forming apparatus of claim 7, wherein the rotation control unit comprises a spring clutch.

12. The color image forming apparatus of claim 7, wherein the rotation control unit is capable of rotating clockwise and counterclockwise.

13. A color image forming apparatus comprising:

a photoconductive medium to form electrostatic latent images;

a plurality of developing rollers to develop electrostatic latent images formed on the photoconductive medium, each developing roller having a developing roller gear to drive the developing roller; and means to selectively drive the developing rollers comprising, a driving source, a driving gear connected to the driving source, a single power switching gear engaged with the driving gear and rotated along a circumference of the driving gear, and a rotation unit to rotate the power switching gear so that the power switching gear is sequentially placed into contact with each of the developing roller gears of the plurality of developing rollers to transmit power from the driving gear to the selected developing roller gear.

14. The color image forming apparatus of claim 13, wherein the rotation unit comprises:

a rotary lever having a first and a second end, the first end being rotatably supported, and the second end being connected to the power switching gear; and a rotation control unit connected to the first end of the rotary lever to control the rotational position of the rotary lever.

15. The color image forming apparatus of claim 14, wherein the axis of the rotary lever corresponds to the axis of the driving gear.

16. The color image forming apparatus of claim 14, wherein the rotation control unit comprises a stepping motor.

17. The color image forming apparatus of claim 14, wherein the rotation control unit comprises a spring clutch.

18. The color image forming apparatus of claim 14, wherein the rotation control unit is capable of rotating clockwise and counterclockwise.

* * * * *

UNITED STATES PATENT AND TRADEMARK OFFICE

CERTIFICATE OF CORRECTION

PATENT NO. : 7,610,000 B2
APPLICATION NO. : 11/481815
DATED : October 27, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 654 days.

Signed and Sealed this

Twelfth Day of October, 2010

David J. Kappos

David J. Kappos
*Director of the United States Patent and Trademark Office*